US010587957B2

(12) United States Patent
Kajanus

(10) Patent No.: US 10,587,957 B2
(45) **Date of Patent: *Mar. 10, 2020**

(54) APPARATUS FOR GENERATING VIBRATION

(71) Applicant: PS AUDIO DESIGN OY, Oulu (FI)

(72) Inventor: Vesa Kajanus, Oulu (FI)

(73) Assignee: PS AUDIO DESIGN OY, Oulu (FI)

( * ) Notice: Subject to any disclaimer, the term of this patent is extended or adjusted under 35 U.S.C. 154(b) by 0 days.

This patent is subject to a terminal disclaimer.

(21) Appl. No.: 16/427,377

(22) Filed: May 31, 2019

(65) Prior Publication Data

US 2019/0289399 A1 Sep. 19, 2019

Related U.S. Application Data

(63) Continuation of application No. 16/138,993, filed on Sep. 22, 2018, now Pat. No. 10,349,179, which is a (Continued)

(30) Foreign Application Priority Data

Nov. 18, 2014 (GB) ..... 1420483.8

(51) Int. Cl.
*H04R 9/02* (2006.01)
*H04R 9/06* (2006.01)
(Continued)

(52) U.S. Cl.
CPC ..... *H04R 9/025* (2013.01); *H04R 9/06* (2013.01); *H04R 11/02* (2013.01); *H04R 13/00* (2013.01);
(Continued)

(58) Field of Classification Search
CPC ..... H04R 9/025; H04R 9/027; H04R 9/045; H04R 9/06; H04R 2209/024; H04R 2400/07
See application file for complete search history.

(56) References Cited

U.S. PATENT DOCUMENTS 3,937,904 A 2/1976 Parker
6,618,487 B1 9/2003 Azima et al.
(Continued)

FOREIGN PATENT DOCUMENTS

CN 1658707 A 8/2005
CN 101971644 A 2/2011
(Continued)

OTHER PUBLICATIONS

Great Britain Search Report, Application No. GB1420483.8, 5 pages, dated Mar. 6, 2015.
(Continued)

*Primary Examiner* — Joshua Kaufman
(74) *Attorney, Agent, or Firm* — FisherBroyles, LLP

(57) ABSTRACT

An apparatus includes a surface arranged to be mechanically displaced, first permanent magnet coupled with the surface, at least one supporting member for supporting the surface, base, second permanent magnet, coil coupled with the second magnet, and signal port electrically coupled with the coil. An electrical signal is configured to travel between the signal port and the coil. The electrical signal in the coil is proportional to mechanic displacement of the surface when a force equilibrium state of the surface is broken by the electrical signal in the coil or the mechanic displacement of the surface from a position of the force equilibrium state. The coil is arranged at least partially between the first magnet and the second magnet or around one of the first magnet, the second magnet. Either the same or different polarities of the first and second magnets are arranged to directly face each other at a distance.

17 Claims, 3 Drawing Sheets

Related U.S. Application Data continuation of application No. 15/526,281, filed as application No. PCT/FI2015/050799 on Nov. 18, 2015, now Pat. No. 10,123,123.

(51) Int. Cl.

| | |
|---|---|
| ***H04R 13/00*** | (2006.01) |
| ***H04R 11/02*** | (2006.01) |
| *H04R 9/04* | (2006.01) |

(52) U.S. Cl.

CPC ..... *H04R 9/045* (2013.01); *H04R 2209/024* (2013.01); *H04R 2400/07* (2013.01)

(56) References Cited

U.S. PATENT DOCUMENTS

| | | | | |
|---|---|---|---|---|
| 6,658,133 | B1 | 12/2003 | Usuki et al. | |
| 6,671,383 | B2 | 12/2003 | Usuki et al. | |
| 7,030,522 | B2 | 4/2006 | Nakajima et al. | |
| 7,764,803 | B2 | 7/2010 | Kang | |
| 8,462,977 | B2 | 6/2013 | Wang | |
| 8,660,279 | B2 | 2/2014 | Varla et al. | |
| 2002/0037089 | A1* | 3/2002 | Usuki | B06B 1/045 381/396 |
| 2006/0012559 | A1* | 1/2006 | Kang | H04R 7/04 345/108 |
| 2011/0317859 | A1* | 12/2011 | Jinton | H04R 25/606 381/326 |
| 2013/0106205 | A1* | 5/2013 | Clamme | H02K 33/02 310/28 |
| 2014/0185859 | A1 | 7/2014 | Wilk et al. | |

FOREIGN PATENT DOCUMENTS

| | | | |
|---|---|---|---|
| DE | 69916969 | T2 | 9/2004 |
| GB | 1206917 | | 9/1970 |
| GB | 2515098 | A | 12/2014 |
| WO | 2010004285 | A1 | 1/2010 |
| WO | 2011132203 | A1 | 10/2011 |
| WO | 2012085350 | A1 | 6/2012 |

OTHER PUBLICATIONS

International Search Report and Written Opinion, Application No. PCT/FI2015/050799, 11 pages, dated Feb. 3, 2016.

Great Britain Action, Application No. GB1420483.8, 2 pages, dated Nov. 2, 2016.

Search Report from the Patent Office of the People's Republic of China for Patent Application No. 201580061709.5, dated Mar. 8, 2018, 2 pgs.

Communication from the European Patent Office for Patent Application No. 15801194.0, dated Jul. 17, 2018, 8 pgs.

Second Office Action from the Patent Office of the People's Republic of China for Patent Application No. 201580061709.5, dated Jul. 20, 2018, 6 pgs.

* cited by examiner

APPARATUS FOR GENERATING VIBRATION

CROSS-REFERENCE TO RELATED APPLICATIONS

This application is a continuation of U.S. application Ser. No. 16/138,993 filed Sep. 22, 2018, which is a continuation of U.S. application Ser. No. 15/526,281, filed May 11, 2017, which is a National Stage application of International Application No. PCT/FI2015/050799, filed Nov. 18, 2015, which claims priority to Great Britain Application No. 1420483.8, filed Nov. 18, 2014, which are incorporated by reference herein in their entireties.

BACKGROUND

Field

This invention relates to apparatuses for generating vibration. More particularly, the present invention relates to inducing changes in a magnetic field between a surface and a base of an apparatus to generate vibration.

Related Art

Apparatuses for generating vibration are used in many different places to produce vibration such as sound. Integrating apparatuses for generating vibration into other devices and structures may be practical.

SUMMARY

According to an aspect, there is provided an apparatus comprising: a surface arranged to be mechanically displaced; a first permanent magnet coupled with the surface; at least one supporting member for supporting the surface; a base; a second permanent magnet coupled with the base; a coil; and a signal port electrically coupled with the coil, wherein an electrical signal is configured to travel between the signal port and the coil, wherein a magnetic field between the first magnet and the second magnet causes a force to the surface, wherein an entity, comprising the surface and the at least one supporting member, comprises at least one elastic element providing a supporting counterforce acting as a counterforce to the force caused by the magnetic field, causing the surface to be in a force equilibrium state, and wherein the electrical signal in the coil is proportional to mechanic displacement of the surface when the force equilibrium state is broken either by the electrical signal in the coil or the mechanic displacement of the surface from a position of the force equilibrium state, wherein the coil is arranged at least partially between the first magnet and the second magnet or around one of the first magnet, the second magnet, and wherein either the same or different polarities of the first and second magnets are arranged to directly face each other at a distance.

Some further embodiments are defined in the dependent claims.

BRIEF DESCRIPTION OF THE DRAWINGS

In the following the invention will be described in greater detail by means of preferred embodiments with reference to the attached drawings, in which.

DETAILED DESCRIPTION

The following embodiments are exemplary. Although the specification may refer to "an", "one", or "some" embodiment(s) in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may contain also features/structures that have not been specifically mentioned.

Figure 1:
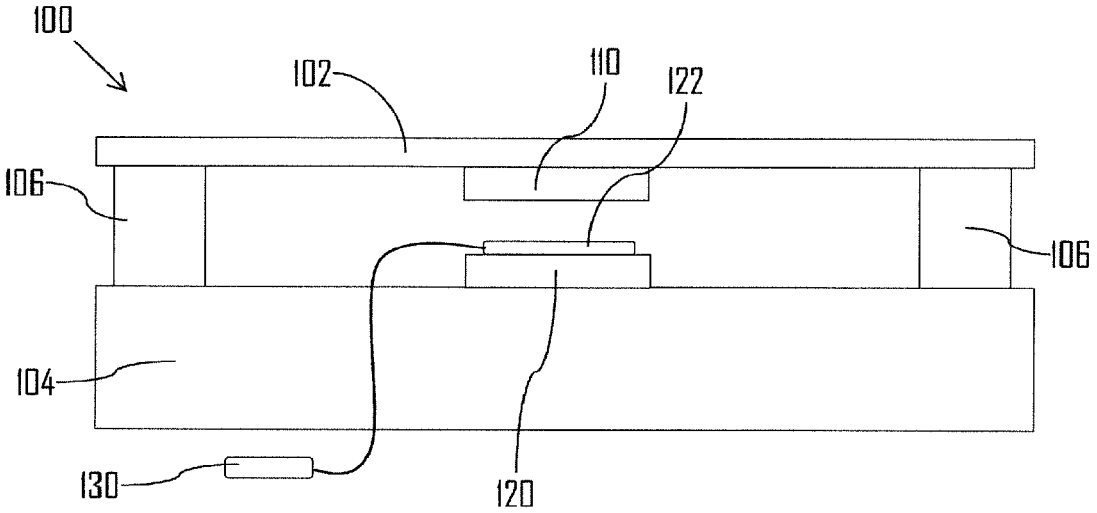
FIG. 1 illustrates an apparatus according to an embodiment of the invention.

FIG. 1 illustrates an apparatus 100. Referring to FIG. 1, the apparatus 100 comprises: a surface 102 arranged to be mechanically displaced, a first magnet 110 coupled with the surface 102, at least one supporting member 106 for supporting the surface 102, a base 104 comprising a second magnet 120, wherein the second magnet 120 is arranged, at least partially, to face the first magnet 110, a coil 122 coupled with the second magnet 120, and a signal port 130 electrically coupled with the coil 122, wherein an electrical signal is configured to travel between the signal port 130 and the coil 122, wherein a magnetic field between the first magnet 110 and the second magnet 120 causes a force to the surface 102, wherein an entity, comprising the surface 102 and the at least one supporting member 106, comprises at least one elastic element providing a supporting counterforce acting as a counterforce to the force caused by the magnetic field, causing the surface 102 to be in a force equilibrium state, and wherein the electrical signal in the coil 122 is proportional to mechanic displacement of the surface 102 when the force equilibrium state is broken either by the electrical signal in the coil 122 or the mechanic displacement of the surface 102 from a position of the force equilibrium state.

In an embodiment, the electrical signal is be fed from the signal port 130 to the coil 122. Thus, it may travel from the signal port 130 to the coil 122.

In an embodiment, the apparatus 100 of FIG. 1 is a loudspeaker 100 for producing sound. The loudspeaker 100 may be used as regular loudspeaker, such as a computer loudspeaker, loudspeaker or television loudspeaker, or as an integrated loudspeaker. The integrated loudspeaker may mean a loudspeaker that is, for example, integrated in wall structures, electronic devices or floor panels, and uses mentioned structures and devices as a part of the loudspeaker.

The loudspeaker 100 may comprise a surface 102 configured to produce sound from vibration of the surface 102 and a first magnet 110 coupled with the surface. The first magnet 110 may be fixed to the surface 102. In an embodiment, the surface 102 comprises the first magnet 110. The loudspeaker 100 may further comprise at least one supporting member 106 for supporting the surface 102. The loudspeaker 100 may also comprise a base 104 comprising a second magnet 120, wherein the second magnet 120 may be arranged, at least partially, to face the first magnet 110, and a coil 122 coupled with the second magnet 120. In an embodiment, the coil 122 is fixed to the second magnet 120.

The loudspeaker 100 may further comprises an audio signal input 130 electrically coupled with the coil 122, wherein the audio signal input 130 may be configured to receive an electrical audio signal and transmit the electrical audio signal into the coil 122, and wherein a magnetic field between the first magnet 110 and the second magnet 120 causes a force to the surface 102, wherein an entity, comprising the surface 102 and the at least one supporting member 106, comprises at least one elastic element providing a supporting counterforce acting as a counterforce to the force caused by the magnetic field, causing the surface 102 to be in a force equilibrium state, and wherein the electrical audio signal provided into the coil 122 induces changes in the magnetic field between the first magnet 110 and the second magnet 120, thus changing the strength of the force, and thus making the surface 102 vibrate according to the electrical audio signal. The elastic element may comprise at least one of the surface 102 and the at least one supporting member 106. The induced changes to the magnetic field, by the coil 122, may break the force equilibrium state and make the surface vibrate according to the electrical audio signal, and thus produce sound from the vibration. In an embodiment, the supporting counterforce is caused by at least one of bending the surface 102 and elasticity of the at least one supporting member 106. In an embodiment, the surface 102 is arched.

In an embodiment, the at least one supporting member 106 is pre-tensioned by the magnetic force between the first magnet 110 and the second magnet 120. The pre-tensioning may cause the at least one supporting member 106 to produce a supporting counterforce and thus cause the surface 102 to be in a force equilibrium state.

In an embodiment, the magnetic field between the first magnet 110 and the second magnet 120 causes a magnetic force to the first magnet 110, wherein at least some of the magnetic force is transferred to the surface 102 as a mechanical force. In an embodiment, the magnetic field between the first magnet 110 and the second magnet 120 causes a magnetic force to the first magnet 110 causing a mechanical force to the surface 102.

In an embodiment, the majority of the supporting counterforce is caused by the at least one supporting member 106.

The first magnet 110 and the second magnet 120 described above may be permanent magnets or electromagnets. The magnets 110, 120 may be made of neodymium, iron, nickel, cobalt and their alloys, for example. In an embodiment, the magnets 110, 120 comprise an adjustment mechanism, wherein the adjustment mechanism may be used to change the amount of magnetic flux between the first magnet 110 and the second magnet 120. The adjustment mechanism may be, for example, a mechanical knob or an electrical device which can be used to change the amount of magnetic flux. The adjustment mechanism may be used to change polarities of the magnets 110, 120. The adjustment mechanism may work, for example, by controlling the amount and/or direction of current through the magnets 110, 120. In an embodiment, the adjustment mechanism may control the alignment and/or position of the first magnet 110 and the second magnet 120.

In an embodiment, the surface 102 is made of glass, plastic, metal or wood. The surface 102 may comprise a combination of the said mentioned materials, such as composite. The surface 102 may be a shape of rectangle, square or circle, for example. The surface's 102 shape may also be something else than listed above. In an embodiment, the surface 102 is a part of a display of an electronic apparatus, such as mobile phone, tablet, computer, television or other devices comprising a display. The surface 102 may be, for example, the cover glass or plastic of the display. In an embodiment, the surface 102 is comprised in a panel, a board, a painting, a window, a wall, a floor or a ceiling. The surface 102 may produce sound into or outside a room or a space comprising some of the above mentioned room elements. In an embodiment, the surface 102 is made of non-elastic and/or non-bendable material. This may mean that the surface 102 may not provide any significant part of the supporting counterforce. The surface 102 may be arranged so that there is a gap between the surface 102 and the base 104.

In an embodiment, the surface is at least 1 mm thick. In an embodiment, the surface is at least 10 mm thick. In an embodiment, the surface is at least 10 cm thick.

The equilibrium state of the surface 102 may be achieved with magnets of different capacity. The heavier the surface 102 is, the more magnetic force may be needed. Stronger magnetic force may be achieved by bringing the magnets 110, 120 closer to each other and/or using more powerful magnets 110, 120. The at least one supporting member 106 may be arranged and/or designed so that the supporting counterforce is optimised for the current magnetic force. The force equilibrium state may be thus achieved as the magnetic force and the supporting counterforce may be optimized for different scenarios. The different scenarios may mean, for example, the surface 102 being made of different materials and dimensions.

In an embodiment, the distance between the first magnet 110 and the second magnet 120 is between 0.3 millimetres (mm) and 1.0 mm when the surface 102 is in the force equilibrium state. In an embodiment, the distance between the first magnet 110 and the second magnet 120 is between 1.0 mm and 2.0 mm when the surface 102 is in the force equilibrium state.

In an embodiment, the first magnet 110 and/or the second magnet 120 are made of samarium and/or cobalt. In such case, the $kJ/m^3$ value of the first and/or second magnets 110, 120 may be between 143-159 $kJ/m^3$, for example. In an embodiment, the first magnet 110 and/or the second magnet 120 are made of neodymium and/or ferrite. In such case, the $kJ/m^3$ value of the first and/or second magnets 110, 120 may be between 250-400 $kJ/m^3$, for example.

In an embodiment, at least one of the following is made of iron: the first magnet 110 and the second magnet 120.

The magnetic flux between the first magnet 110 and the second magnet 120 may not change, as the magnets' magnetic properties are not changed, when the loudspeaker 100 is being used. However, by conducting current, such as electrical audio signal, to the coil 122, the coil 122 may produce a further magnetic component inside the magnetic field between the first magnet 110 and the second magnet 120. This extra magnetic component may increase or decrease the magnetic field, and thus the magnetic force, depending on the setup of the magnets 110, 120 and the direction of the current, and cause the displacement of the surface 102 with respect to the base 104, and sound generation. The supporting counterforce may increase as the magnetic force increases. The supporting counterforce may increase in an effort to try restoring the equilibrium state. The supporting counterforce may increase with a delay compared to the magnetic force thus enabling the surface's 102 vibration. The supporting counterforce may decrease as the magnetic force decreases similarly to the increasing of the forces.

In an embodiment, the coil 122 is arranged between the first magnet 110 and second magnet 120. This may improve the effectiveness of the electrical audio signal to the magnetic field between the first magnet 110 and the second magnet 120, because the magnetic component caused by the coil 122 may be physically closer to the magnetic field between the magnets 110, 120. The coil 122 may be arranged between the magnets 110, 120 so that the primary magnetic component caused by the coil 122 is parallel to the magnetic field between the magnets 110, 120.

In an embodiment, the apparatus 100 comprises a loudspeaker configured to produce sound, wherein the mechanical displacement of the surface 102 comprises sound producing vibration, wherein the electrical signal comprises an electrical audio signal configured to travel from the signal port 130 to the coil 122, and wherein the electrical audio signal provided into the coil 122 induces changes in the magnetic field between the first and the second magnets 110, 120, thus breaking the force equilibrium state and making the surface 102 vibrate according to the electrical audio signal.

Figure 2A:
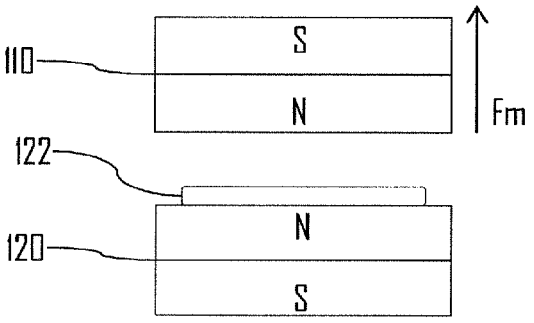
FIGS. 2A and 2B illustrate arrangements of a first magnet and the second magnet according to embodiments of the invention.
Figure 2B:
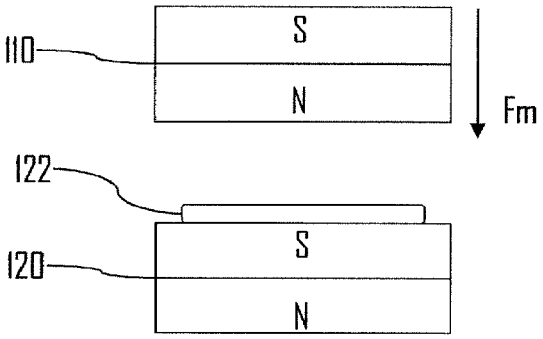

Let us now look a bit closer on the arrangement of the first magnet 110 and the second magnet 120 and the coil 122. FIGS. 2A and 2B illustrate arrangements of the first magnet 110 and the second magnet 120 according to embodiments of the invention. Referring to FIG. 2A, the same polarities of the first magnet 110 and the second magnet 120 may be facing each other. The same polarities in FIG. 2A are shown as north poles of the magnets 110, 120. Similarly, the same polarities may mean south poles of the magnets 110, 120. The first magnet 110 may experience a magnetic force, shown by an arrow Fm. This magnetic force may cause a mechanical force to the surface 102. The direction of the magnetic force may be away from the second magnet 120, as the same polarities may cause a pushing magnetic force on each other. Although not shown in FIG. 2A, the second magnet 120 may experience equal size magnetic force as the first magnet 110, but the direction of the force may be opposite. Referring now to FIG. 2B, the setup may be similar to FIG. 2A, but now the polarities of the first magnet 110 and the second magnet 120 may not be the same. This may cause a pulling magnetic force, as shown by an arrow Fm in FIG. 2B. Although not shown in FIG. 2B, the second magnet 120 may experience equal size magnetic force as the first magnet 110, but the direction of the force may be opposite.

As shown in FIGS. 2A and 2B, the coil 122 may be placed between the magnets 110, 120 to make its use more effective. The magnetic forces described above, shown by arrows Fm, may inflict a force to surface 102 to which the first magnet 110 is coupled with. In an embodiment, the first magnet 110 is fixed to the surface 102 mechanically. In an embodiment the surface 102 and the first magnet may be of one integral part. The surface 102 itself may be made of magnetic material, thus experiencing directly the magnetic forces. The magnetic forces, shown by arrows Fm, may move the first magnet 110 to the direction of the force. The surface 102 may move to the same direction as the first magnet 110, as the surface 102 may be physically connected to the first magnet 110, as described above.

Referring again to FIG. 1, the at least one supporting member 106 may produce supporting counterforce when it is tensioned. The supporting counterforce may be caused by the material's or form's ability to resist changes in the at least one supporting member's 106 shape or form. Tensioning the at least one supporting member 106 may cause the at least one supporting member 106 to produce a supporting counterforce by resisting the shape change. The shape change may be caused by the force to the surface 102, caused by the magnetic field between the first magnet 110 and the second magnet 120. The elasticity of the at least one supporting member 106 may come from the material being used to make the supporting member and/or from its form. The at least one supporting member 106 may be made of foamy elastic material or it may be formed as a spring, for example. In an embodiment, the at least one supporting member 106 is made of porous material.

The at least one supporting member 106 may be disposed between the surface 102 and the base 104. The disposing may mean fixing first area of the at least one supporting member 106 to the surface 102 and a second area to the base 104. The increasing magnetic force, between the first magnet 110 and the second magnet 120, may further tension the at least one supporting member 106, thus increasing the supporting counterforce.

Figure 3:
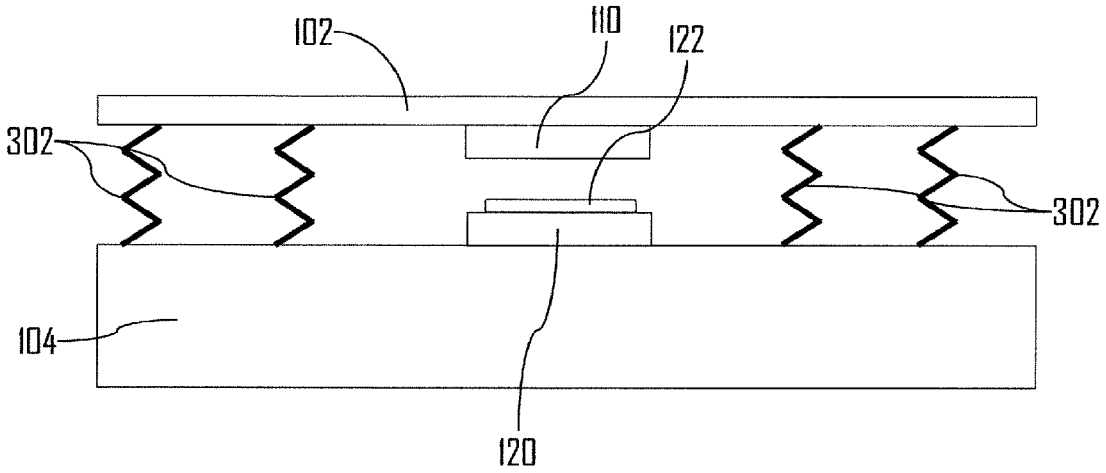
FIG. 3 illustrates a loudspeaker apparatus according to an embodiment of the invention.

FIG. 3 illustrates a loudspeaker apparatus according to an embodiment of the invention. Referring to FIG. 3, the loudspeaker apparatus may be similar or the same as loudspeaker apparatus 100 of FIG. 1. The at least one supporting member 106 may comprise or be at least one elastic supporting member 302. The at least one elastic supporting member 302 may produce a counterforce against the magnetic force between the first magnet 110 and the second magnet 120, when the at least one elastic supporting member 302 is tensioned. In an embodiment, the supporting counterforce increases when the at least one elastic supporting member 302 is stretched by the increasing distance between the surface 102 and the base 104. In an embodiment, the supporting counterforce increases when the at least one elastic supporting member 302 is compressed by the decreasing distance between the surface 102 and the base 104. In an embodiment, the at least one elastic supporting member 302 comprises or is a coil spring.

Figure 4:
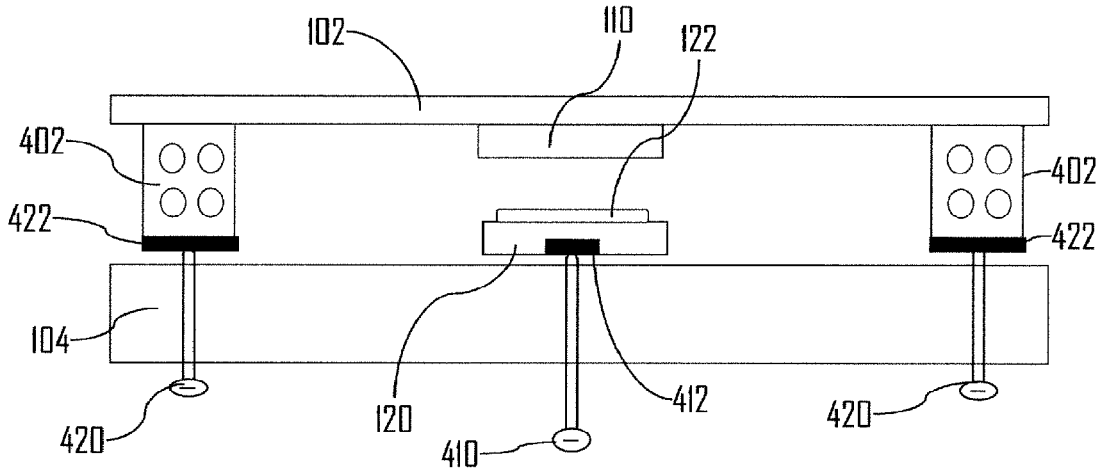
FIG. 4 illustrates a loudspeaker apparatus according to an embodiment of the invention.

FIG. 4 illustrates a loudspeaker apparatus according to an embodiment of the invention. Referring to FIG. 4, the loudspeaker apparatus illustrated may be similar or the same as the loudspeaker apparatus 100 of FIG. 1. The at least one supporting member 106 may comprise or be at least one foamy supporting member 402. The at least one foamy supporting member 402 may be made of foamy elastic material, for example. The at least one foamy supporting member 402 may comprise holes and/or cavities to enhance its elastic properties.

The loudspeaker may comprise an adjustment member for adjusting the distance between the first magnet 110 and the second magnet 120. The adjustment member may comprise a first adjustment screw 410 mechanically coupled with the second magnet 120, wherein by tuning the first adjustment screw 410 the distance of the second magnet 120 to the first magnet 110 can be changed. The adjustment member may further comprise at least one second adjustment screw 420 for adjusting the distance between surface 102 and the base 104. The at least one second adjustment screw 420 may be mechanically coupled with the at least one foamy supporting member 402, wherein by tuning the at least one second adjustment screw 420 the distance between the surface 102 and the base 104 can be changed. In an embodiment, by decreasing the distance between the surface 102 and the base 104, the supporting counterforce increases. In another embodiment, by increasing the distance between the surface 102 and the base 104, the supporting counterforce increases.

The second magnet 120 may comprise a first connection member 412. In an embodiment, the first connection member 412 is fixed to the second magnet 120. The at least one foamy supporting member 402 may comprise at least one second connection member 422. In an embodiment, the at least one second connection member 422 is fixed to the at least one foamy supporting member 402. The first adjustment screw 410 may be fixed to the first connection member 412. The base 104 may contain a hole or an opening for the first adjustment screw 410. Similarly, the base 104 may contain a hole or an opening for the at least one second adjustment screw 420. The at least one second adjustment screw 420 may be fixed to the at least one second connection member 422.

The connection members 412, 422 may comprise a counterpart for the screws 410, 420. The counterparts may be screw holes, for example. The connection members 412, 422 may be metal or plastic plates, for example. In an embodiment, the at least one second connection member 422 compresses or stretches the at least one foamy supporting member 402 as the at least one second adjustment screw 420 is adjusted. In an embodiment, the adjustment member is arranged to change the position of the first magnet 110. The adjustment member may be used to control both the first and second magnets' 110, 120 positions. Although not shown in FIG. 3, similar adjustment member may be used with the at least one elastic supporting member 302. The at least one elastic supporting member 302 may comprise similar connection members as the at least one foamy supporting member 402 of FIG. 4.

In an embodiment, the at least one supporting member 106 is arranged on edge areas of the surface and the distance between the first magnet 110 and a centre of the surface 102 is smaller than the distance between the at least one supporting member 106 and the centre of the surface 102.

In an embodiment, the first magnet 110 is arranged to a centre area of the surface 102.

In an embodiment, there is a gap between the first magnet 110 and the second magnet 120. The gap may be airy. The first magnet 110 and the second magnet 120 may face each other. The first magnet 110 may be fixed to a side of the surface 102 facing the base 104. Similarly, the second magnet 120 may be fixed to a side of the base 104 facing the surface 102.

In an embodiment, the coil 122 is arranged on the side of the second magnet 120.

In an embodiment, the coil 122 is fixed to the first magnet 110.

In an embodiment, the coil 122 is arranged so that there is a gap between the first magnet and the coil 122, and so that there is a gap between the second magnet 120 and the coil 122. The coil may be fixed to the base 104 or the surface 102, for example.

Figure 5:
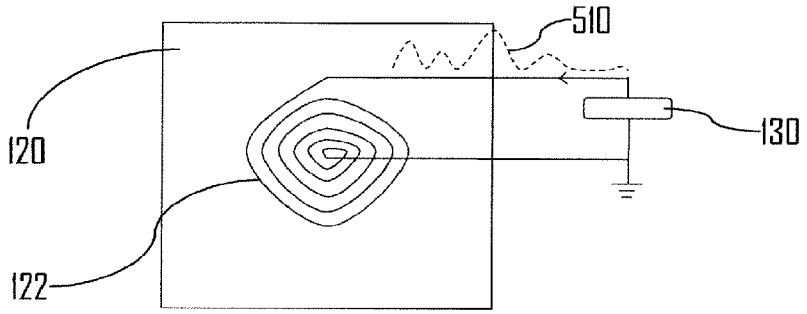
FIG. 5 illustrates an arrangement of a coil according to an embodiment of the invention.

FIG. 5 illustrates an arrangement of the coil 122 according to an embodiment of the invention. Referring to FIG. 5, the coil 122 is arranged on top of the second magnet 120. The coil 122 may be arranged between the first magnet 110 and the second magnet 120. The coil 122 may be fixed to the second magnet 120 with clue, for example. Other fixing methods may also be used. In an embodiment, the second magnet 120 and the coil 122 are of one integral part.

The coil may be electrically coupled to the audio signal input 130. The FIG. 5 illustrates electrical coupling with a wire, but wireless connection may also be possible. The wireless connection may be achieved with induction, for example. The audio signal input 130 may receive an audio signal 510 and transmit it to the coil 122. The audio signal 510 may produce a current to the coil 122. The coil 122 may receive the audio signal 510 that causes the coil 122 to produce a magnetic field. The magnetic field may change according to the audio signal 510. The existing magnetic field between the first magnet 110 and the second magnet 120 may not change, but the coil's 122 magnetic field may add a new magnetic component to the existing magnetic field. The magnetic field between the first and second magnets 110, 120 may thus be a sum of both of the mentioned magnetic fields. The magnetic field may get stronger according to the audio signal 510 and thus the force inflicted to the surface 102 may get stronger. The supporting counterforce described above may also get stronger. This may cause the surface 102 to vibrate and produce sound according to the audio signal 510.

In an embodiment, the magnetic field and thus the magnetic force gets weaker as the audio signal 510 is transmitted to the coil 122. The supporting counterforce may then get smaller according to the changes of the magnetic force. This may cause the surface 102 to vibrate according to the audio signal 510.

In an embodiment, the magnetic force and the supporting counterforce are of equal size when there is no electrical audio signal input into the coil 122.

Figure 6:
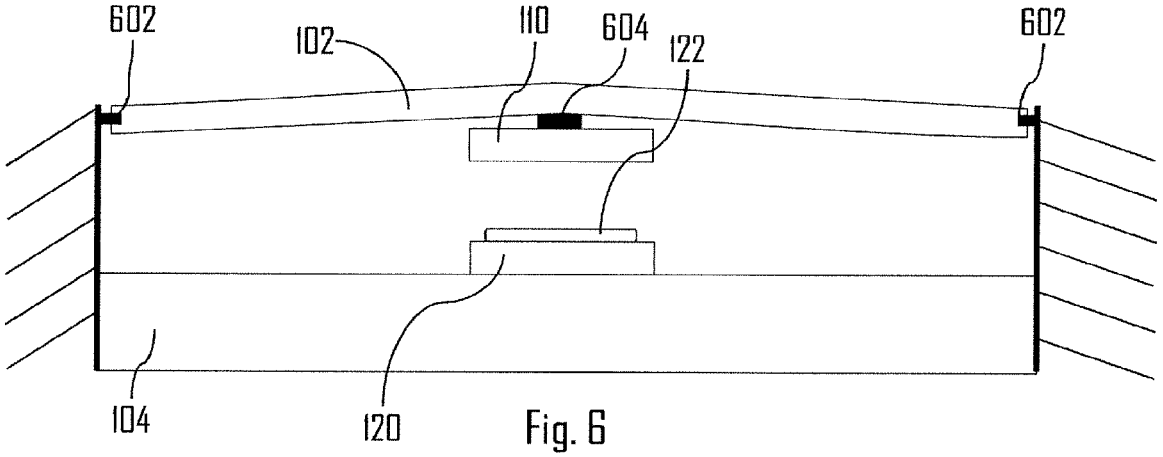
FIG. 6 illustrates a loudspeaker apparatus according to an embodiment of the invention.

FIG. 6 illustrates a loudspeaker apparatus according to an embodiment of the invention. Referring to FIG. 6, the loudspeaker apparatus illustrated may be similar or the same as the loudspeaker apparatus 100 of FIG. 1. The at least one supporting member 106 may comprise or be at least one non-elastic fixing member 602. The at least one non-elastic fixing member 602 may be a screw or a protrusion, for example. The supporting counterforce, described above, may be produced by the surface 102 structure or form itself. The surface may act as an elastic structure creating a supporting counterforce to the magnetic force, between the first magnet 110 and the second magnet 120, either pulling it or pushing the surface 102. The at least one non-elastic fixing member 602 may keep the surface 102 stationary from one or more connection areas, but enable the movement of other areas of the surface 102.

The loudspeaker may comprise fixing member 604 to fix the first magnet 110 to the surface 102. Similar fixing member may be used in other embodiments of the invention as well. The fixing member 604 may provide a wider range for the surface 102 to bend and create supporting counterforce to the magnetic force.

In an embodiment, the primary supporting counterforce is caused by the bending surface 102. The surface 102 may be made of elastic material to enhance the produced supporting counterforce by the bending surface 102.

Figure 7:
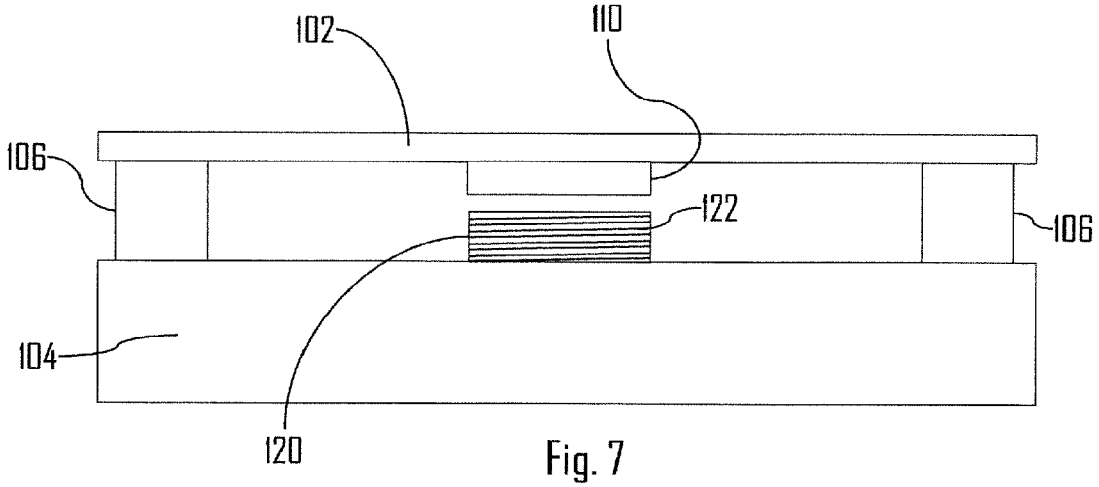
FIG. 7 illustrates an embodiment of the invention.

FIG. 7 illustrates an embodiment of the invention. Referring to FIG. 7, the coil 122 may be arranged to be situated at least on one side of the second magnet 120. This may mean that the coil 122 is not situated between the first and the second magnets 110, 120. The coil 122 may be, for example, rolled around the second magnet 120. As the coil 122 may be situated on the at least one side of the second magnet 120, the distance between the first and second magnet 110, 120 may be reduced. This may mean that the magnetic force may be increased. Furthermore, the surface 102 may be pre-tensioned more, and thus the reaction of the surface 102, to the force caused by the coil 122, may be faster. In an embodiment, the coil 122 is rolled around the first magnet 110. In an embodiment, the coil 122 is attached to the first magnet 110. Thus, the coil 122 may be located at the side of the first magnet 110, for example.

Even though the invention has been described above with reference to an example according to the accompanying drawings, it is clear that the invention is not restricted thereto but can be modified in several ways within the scope of the appended claims. Therefore, all words and expressions should be interpreted broadly and they are intended to illustrate, not to restrict, the embodiment. It will be obvious to a person skilled in the art that, as technology advances, the inventive concept can be implemented in various ways. Further, it is clear to a person skilled in the art that the described embodiments may, but are not required to, be combined with other embodiments in various ways.

What is claimed is:

1. A loudspeaker apparatus comprising:

a surface arranged to be mechanically displaced;

a first permanent magnet configured to be coupled with the surface;

at least one supporting member for supporting the surface;

a base;

a second permanent magnet configured to be coupled with the base, wherein either the same or different polarities of the first and second permanent magnets are configured to directly face each other at a distance such that there is a gap between the first and second permanent magnets;

a coil; and a signal port electrically coupled with the coil, wherein an electrical audio signal is configured to travel between the signal port and the coil, wherein the surface is configured to produce sound according to the electrical audio signal, and wherein the coil is arranged around an outer shell of a respective permanent magnet that is either the first permanent magnet or the second permanent magnet, and the respective permanent magnet is inside the coil.

2. The loudspeaker apparatus of claim 1, wherein a majority of force supporting the surface is caused by the at least one supporting member.

3. The loudspeaker apparatus of claim 1, wherein the at least one supporting member is disposed between the surface and the base.

4. The loudspeaker apparatus of claim 1, wherein the at least one supporting member comprises at least one elastic fixing member.

5. The loudspeaker apparatus of claim 1, wherein the apparatus further comprises an adjustment member for adjusting the distance between the first and second permanent magnets.

6. The loudspeaker apparatus of claim 1, wherein the at least one supporting member is arranged on edge areas of the surface.

7. The loudspeaker apparatus of claim 6, wherein the distance between the first permanent magnet and a center area of the surface is smaller than the distance between the at least one supporting member and the center area of the surface.

8. The loudspeaker apparatus of claim 1, wherein the first permanent magnet is arranged to a center area of the surface.

9. The loudspeaker apparatus of claim 1, wherein the first and second permanent magnets comprise at least one of samarium, cobalt.

10. The loudspeaker apparatus of claim 1, wherein the first and second permanent magnets comprise at least one of neodymium, ferrite.

11. The loudspeaker apparatus of claim 1, wherein the surface is a part of a display of an electronic apparatus.

12. The loudspeaker apparatus of claim 11, wherein the electronic apparatus is a mobile phone.

13. The loudspeaker apparatus of claim 11, wherein the surface comprises cover glass or cover plastic of the display of the electronic apparatus.

14. The loudspeaker apparatus of claim 1, wherein the coil is arranged around the first permanent magnet.

15. The loudspeaker apparatus of claim 1, wherein the coil is arranged around the second permanent magnet.

16. The loudspeaker apparatus of claim 1, wherein the coil is fixed to the base or to the surface.

17. The loudspeaker apparatus of claim 1, wherein the coil is arranged around the second permanent magnet, wherein a gap is configured between the coil and the second permanent magnet.

* * * * *